United States Patent [19]

Watson

[11] Patent Number: 4,727,809

[45] Date of Patent: Mar. 1, 1988

[54] DETONATION SAFETY MECHANISM

[75] Inventor: Robert C. M. Watson, Camberley, England

[73] Assignee: The Marconi Company Limited, England

[21] Appl. No.: 938,079

[22] Filed: Dec. 4, 1986

[30] Foreign Application Priority Data

Dec. 6, 1985 [GB] United Kingdom ..... 8530141

[51] Int. Cl.[4] ..... F42C 15/34; F42C 15/40

[52] U.S. Cl. ..... 102/254; 102/206; 102/229; 102/262

[58] Field of Search ..... 102/229, 235, 244–246, 102/251, 254–256, 262, 267, 268, 206, 406, 200

[56] References Cited

U.S. PATENT DOCUMENTS

| | | | |
|---|---|---|---|
| 1,850,196 | 3/1932 | Bardsley | 102/229 |
| 2,737,890 | 3/1956 | Brode | 102/229 |
| 2,790,390 | 4/1957 | Baker | 102/245 |
| 3,744,421 | 7/1973 | Seeger | 102/254 |
| 3,906,861 | 9/1975 | Hamilton et al. | 102/251 X |
| 4,090,450 | 5/1978 | Nygards | 102/254 |
| 4,292,895 | 10/1981 | Bell et al. | 102/254 X |
| 4,534,292 | 8/1985 | Weber et al. | 102/256 X |

*Primary Examiner*—David H. Brown

*Attorney, Agent, or Firm*—Kirschstein, Kirschstein, Ottinger & Israel

[57] ABSTRACT

A safety device for use in the detonation of explosives, mines etc. Explosives are commonly detonated by a two stage operation, an explosive pellet is moved from a safe to an active position and then a hammer or electrical charge is fired to detonate the pellet. Failure of the second stage operation leaves the explosive in an unsafe condition, since the hammer or charge might fall as the fault is being investigated. The invention provides movement of the pellet from one safe position to another continuously and through an active position. If the hammer fails to fall as the pellet passes through the active position the device will assume a safe condition.

11 Claims, 4 Drawing Figures

DETONATION SAFETY MECHANISM

BACKGROUND OF THE INVENTION

1. Field of the Invention

This invention relates to a safety mechanism, for use in the detonation of explosives.

2. Description of Related Art

The main charge in an explosive weapon, e.g. a mine, is normally detonated by a small explosive pellet (with one or more intermediate explosive stages). The pellet is stored in a safe position in which it cannot be activated and, when the weapon is armed, is moved into an active position where it is in line with an intermediate explosive which in turn is contiguous with the main charge. In the active position, mechanical energy, e.g. a spring loaded hammer, or electrical energy, e.g. a current pulse through an inbuilt resistor, is injected into the initiating pellet when the weapon is required to be fired. In the case of the mechanical hammer the pellet must of course be under the hammer in the active position in order to be struck, and in the case of the electrical impulse the resistance wire is only in circuit when the pellet is in the active position.

All movement of the mine is carried out with the pellet locked in the safe stored position and only when the weapon is to be armed is the pellet moved to the active position. A single event, electrical or mechanical stimulus, is then required to explode the weapon.

However, unsafe conditions can arise from many causes, particularly when, after arming, the mechanical or electrical stimulus fails to trigger the explosion. The pellet is then in the active position and it is not known whether the stimulus will arise unexpectedly at any moment.

SUMMARY OF THE INVENTION

It is an object of the invention to provide a safety mechanism which will largely prevent such unsafe conditions occurring.

According to the invention, a safety mechanism for use in the detonation of an explosive charge comprises triggering means to detonate the charge, and a carrier which is continuously movable by motive power means from a first safe position through an active position to a second safe position, the carrier permitting detonation of the charge only while occupying the active position. The charge may be a relatively small charge, the detonation of which is arranged to lead to the detonation of a relatively large main explosive. The carrier may be adapted to carry the charge.

The mechanism preferably includes latching means arranged to hold the carrier in the first safe position and to be released by a firing signal and which may hold the carrier against the motive power means. Alternatively, or in addition, the motive power means may be arranged to urge the carrier from the first to the second safe position in response to an actuating signal.

The triggering means may include an electrical contact arranged to provide an electrical connection when the carrier occupies the active position with a conductor which may be carried by the carrier.

The mechanism may comprise means to provide confirmatory firing indications in dependence upon one or more specified conditions being satisfied.

There may be an alternative path for the carrier from the first safe position to the second safe position, the alternative path not including the active position, and the mechanism including means for directing the carrier along the alternative path in the absence of one or more confirmatory firing indications.

The mechanism preferably includes means for locking the carrier in the second safe position automatically on assuming that position.

There may be included means for inhibiting the release of the latching means in the absence of one or more confirmatory firing indications, and/or means for inhibiting the triggering means in the absence of one or more confirmatory firing conditions.

BRIEF DESCRIPTION OF THE DRAWINGS

A safety mechanism for use in the detonation of explosives will now be described, by way of example, with reference to the accompanying drawings, of which.

DETAILED DESCRIPTION OF THE PREFERRED EMBODIMENTS

Figure 1:
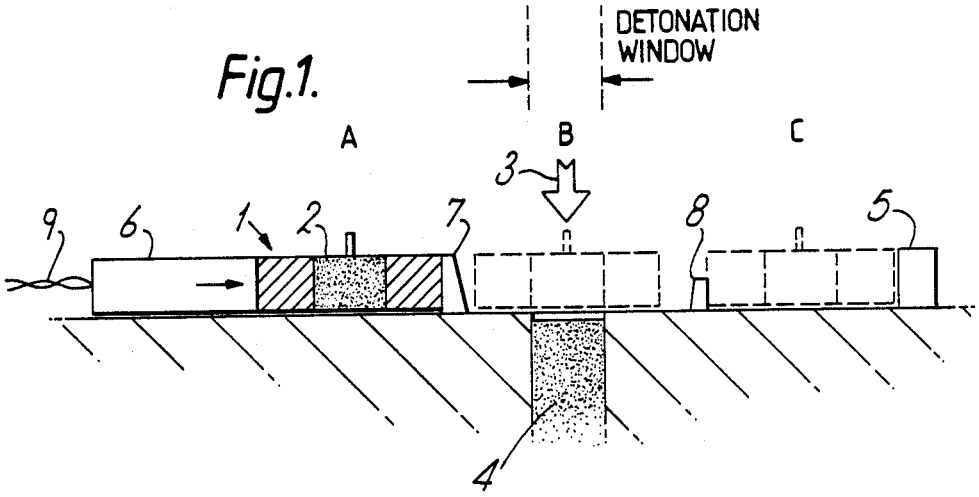
FIG. 1 is a diagrammatic illustration of a linear safety firing mechanism.

Referring to the drawings, FIG. 1 shows a carrier 1 which contains an explosive charge 2.

The carrier is driven by motive power means 6 which may be a piston motor, spring, compressed gas driven plunger, solenoid, or similar device. This source 6 is shown as triggered by electrical connections 9.

The carrier 1, shown in full lines, with the explosive charge at position A, is in a first safe position, the normal position for storage and transit. In this position the charge 2 is out of line with a striker 3 and an explosive relay charge 4, the latter being an intermediate charge in an explosive chain leading to explosion of the bulk of the mine. A latch 7 retains the carrier in this safe, storage, position until an activating signal triggers the motive power source 6 and removes the latch 7.

The carrier 1 is guided, by means not shown, in a path which carries it across the relay charge 4, as shown at B in broken lines, at which active position the charge 2 is in line with the striker 3. The striker is triggered by a firing signal to strike the explosive element 2 at position B, the firing signal being produced, in an interactive arrangement, by a contact operated by the carrier and a further permissive contact not shown.

If the element 2 does not explode at position B the carrier will be driven further to a second safe position, a relaxed position as indicated at C where again the explosive element is out of line with the striker 3 and relay charge 4. When the carrier arrives at position C it is automatically locked in that position. This locking arrangement is shown diagrammatically as a stop member 5 and a retractable member 8. The member 8 is forced to retract by the carrier as this moves rapidly in the direction from B to C, and it then springs back immediately to prevent the carrier bouncing off the stop member 5 back towards B, and to prevent any other accidental movement in that direction.

In an alternative firing arrangement the striker 3 is replaced by an electrical resistance built in to the charge 2, a firing circuit through the resistance being completed by a contact closed only in position B, as described in more detail below.

In normal operation the source 6 is energised and the carrier is driven from the first safe position through the active position B and, if the striker does not work, on continuously to the second safe position at C. This travel takes about 10 to 20 milliseconds.

Inadvertent release of the carrier through an accident, fire or fault will cause the explosive charge to move rapidly from the first safe 'stored' position out of line with the remaining explosive train to the second safe 'relaxed' position where it is locked out of line in order to prevent further movement.

Figure 2:
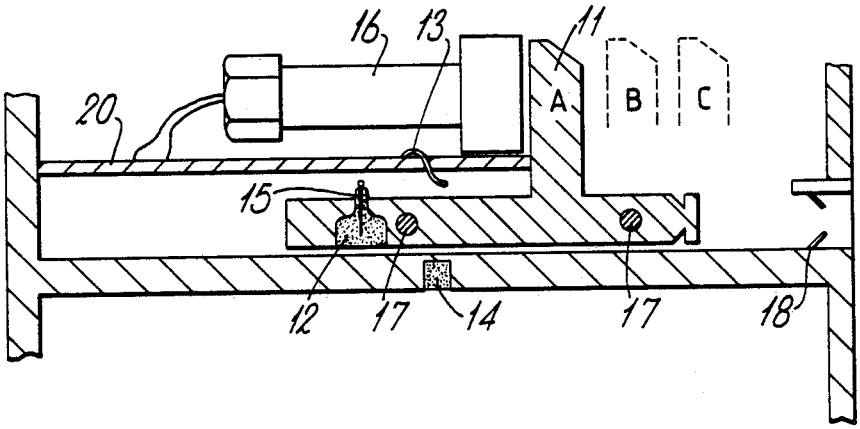
FIG. 2 is a more detailed illustration of a linear safety mechanism.

FIG. 2 shows the mechanism in more detail. The carrier 11 is shown in its first safe position A. During transit or storage the carrier is locked in this position by mechanical locks 17; these are withdrawn as part of the arming process. The motive power means in this case is a piston motor 16 which drives the carrier 11 towards the second safe position C where it is locked in place automatically by barb locks 18. As the carrier travels from A to C the explosive pellet 12 carried by the carrier draws into line with the relay charge 14. A conductive element 15 is incorporated in the pellet and when this element is loaded with current the heat generated causes the pellet to explode. In this position in line with the relay charge, which is the active position B, contact is made between the element 15 and a trigger indicated by a firing contact 13. If a triggering signal is applied whilst the carrier is in position B the pellet 12 explodes, causing the relay charge 14 also to explode. If no signal is applied at this point, or if a signal is applied when the carrier is in position other than position B, the pellet will not explode.

The control circuitry for the mechanism is provided on a printed circuit board 20. The circuitry controls the application to the firing contact 13 of the triggering signal which may be subject to one or more confirmatory signals. It may also control an electronically controlled latch (not shown) which may be provided as an extra safety device in addition to the locks 17. In the case of a stored energy device such as a compressed spring, a single electronic latch may release both the carrier for movement and the stored energy from the spring. The circuitry can also be arranged to provide an indication of the state of the mine, i.e. whether it has not yet been activated (position A) or has been activated (and is therefore in position C) but not fired in the absence of a confirmatory signal, or possibly, has been activated and triggered, but has failed to explode.

Figure 3:
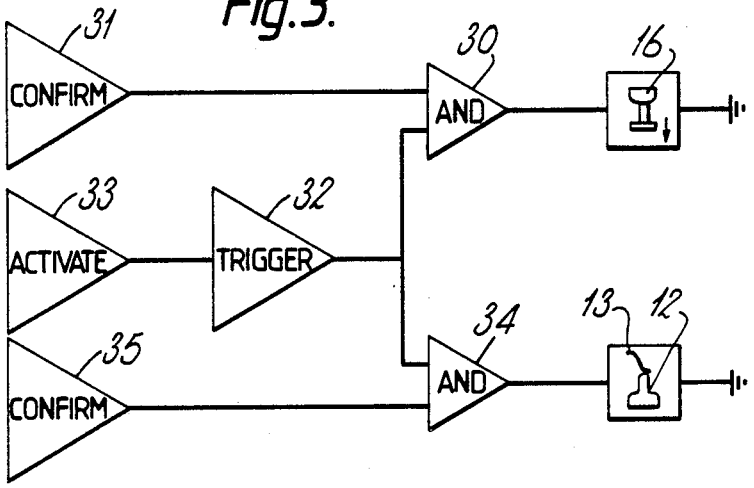
FIG. 3 is a logic diagram of the triggering circuit.

FIG. 3 is a logic diagram for the operation of a typical triggering circuit, excluding any latching means. The motive power source 6 (such as piston motor 16) is activated or not according to the output from a first AND gate 30. The inputs to this gate are derived from a first confirmatory signal source 31 and from a trigger source 32. The signal from the trigger source is provided in response to an activating signal from an activating system 33, such as a vibration sensor or a radio signal receiver. The confirmatory signal source here is taken to be an on/off switch set to 'on' as part of the arming process. The piston motor therefore only acts to drive the carrier when both the trigger control signal and the confirmatory signal are present. A second AND gate 34 provides the firing signal if and only if both the trigger control signal and a second confirmatory signal from source 35 are present. The gate 34 constitutes means for inhibiting trigger means from detonating the explosive charge. The confirmatory signal sources 31, 35 constitute means for providing confirmatory firing indications. If this firing signal is provided when the carrier reaches position B, the pellet 12 is exploded and the explosive train propagates. If the output from either AND gate is a zero the carrier continues to position C with the unexploded pellet.

Figure 4:
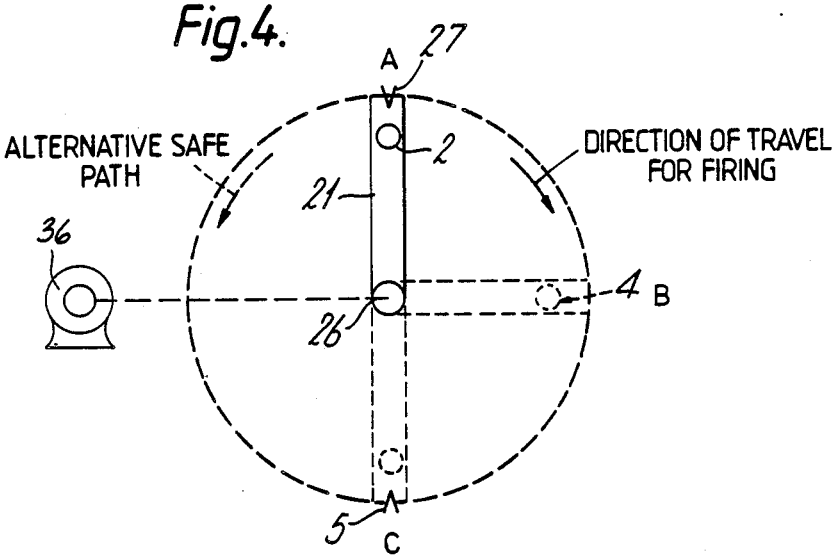
FIG. 4 is a diagrammatic illustration of an alternative rotary mechanism.

FIG. 4 shows an alternative, rotary, arrangement in which the carrier 21 is an arm mounted for rotation about a shaft 26 driven by a rotary source 36. The detonation window at position B occurs between a first safe position A and a diametrically opposite, second safe position C. The charge 4 is positioned at B as before. The alternative, anticlockwise, path from A to C avoids the active position B.

In operation, the firing signal which drives the carrier is arranged to cause rotation in the anticlockwise direction in the absence of a firing indication, indicating that firing is intended. The carrier is automatically locked in the second safe positon (C) as before, thus preventing any subsequent passage into or through the active position.

In another possible rotary arrangement (not shown) the rotating arm carrying the charge is replaced by a plate, solid except for a small cut-out window. The charge is positioned, stationary, beneath the plate and is concealed by the plate in a first safe position A. In operation, as the plate rotates the window moves over the charge exposing it briefly to be struck by a mechanical trigger, then concealing it again.

It will be seen that in all embodiments of the invention the firing stimulus necessary to cause detonation is only effective in triggering the detonation of the main charge during the period of time that the detonator or explosive pellet is transitting the live window position. The two stimuli required to achieve this condition i.e., carrier release and striker release or firing pulse can be made either interactive or independent but they must coincide in time. The efficiency of the system depends upon this need for the firing stimulus, be it mechanical striker or electrical pulse, to be applied whilst the explosive charge (detonator, explosive relay pellet or stemming) is in transit through the live, 'in line', window position if detonation of the main charge is to occur. Any misalignment of time or position of the firing stimulus and the detonator or explosive relay pellet gives a safe outcome. Hence there is but one unique coincidence of space and time during which the explosive train is able to fire and propagate.

I claim:

1. A safety mechanism for use in the detonation of an explosive charge and comprising a carrier, there being a first and a second safe position and an intermediate active position for said carrier, triggering means for detonating said charge and motive power means for urging the carrier continuously from said first safe position through said active position to said second safe position, the mechanism permitting detonation of said charge only while said carrier is occupying said active position.

2. A safety mechanism according to claim 1 including means for generating an actuating signal and wherein said motive power means is arranged to urge the carrier from said first to said second safe position in response to said actuating signal.

3. A safety mechanism according to claim 1 wherein said triggering means includes an electrical contact and said carrier carries a conductor, an electrical connection being made between said contact and said conductor when the carrier occupies said active position.

4. A safety mechanism according to claim 1 including means for locking the carrier in said second safe position automatically on assuming that position.

5. A safety mechanism according to claim 1 including means for locking said carrier in said first safe position during storage or transit.

6. A safety mechanism according to claim 1 for detonating a relatively large main explosive charge, wherein said triggering means comprises a relatively small charge and means for detonating said small charge, the detonation of said small charge causing the detonation of said main charge.

7. A safety mechanism according to claim 6 wherein said carrier carries small charge.

8. A safety mechanism according to claim 1 including latching means for holding the carrier in said first safe position and means for generating a firing signal, said latching means being released by a said firing signal.

9. A safety mechanism according to claim 8 wherein said latching means is operative to hold the carrier in said first safe position against said motive power means.

10. A safety mechanism according to claim 8 comprising means for providing confirmatory firing indications in dependence upon one or more specified conditions being satisfied and wherein there is an alternative path for said carrier from said first safe position to said second safe position, the alternative path not including said active position, and the mechanism including means for directing the carrier along said alternative path in the absence of one or more of said confirmatory firing indications.

11. A safety mechanism according to claim 8 including means for providing confirmatory firing indications in dependence upon one or more specified conditions being satisfied and means for inhibiting said triggering means in the absence of one or more of said confirmatory firing indications.

* * * * *